United States Patent [19]

Keefe

[11] Patent Number: 4,561,186

[45] Date of Patent: Dec. 31, 1985

[54] SAW GAGE

[76] Inventor: Arthur N. Keefe, 25 Grove St., Westboro, Mass. 01581

[21] Appl. No.: 579,377

[22] Filed: Feb. 13, 1984

[51] Int. Cl.[4] ..... B27B 17/02; B27G 23/00

[52] U.S. Cl. ..... 33/185 R; 33/138; 30/383

[58] Field of Search ..... 33/185 R, 180 R, 138, 33/137 R, DIG. 1; 30/383

[56] References Cited

U.S. PATENT DOCUMENTS

| | | | |
|---|---|---|---|
| 946,414 | 1/1910 | Wikander | 30/383 |
| 1,492,705 | 5/1924 | Dulczewski | 30/383 |
| 2,800,933 | 7/1957 | Michael | 33/185 R |
| 2,807,292 | 9/1957 | Gelinas | 33/185 R |
| 3,100,937 | 8/1963 | Burch | 33/137 R |
| 3,276,490 | 10/1966 | Johansson | 33/137 R |
| 3,364,580 | 1/1968 | Lucia | 33/185 R |
| 3,465,796 | 9/1969 | Schwankl | 143/32 |
| 3,845,556 | 11/1974 | Edmunson | 30/381 |
| 4,185,382 | 1/1980 | Rawlinson, Jr. | 30/383 |
| 4,275,504 | 6/1981 | Chontos | 33/138 |
| 4,299,034 | 11/1981 | DeBetta | 33/185 R |
| 4,341,018 | 7/1982 | Nelson | 30/383 |
| 4,377,910 | 3/1983 | Landry, Jr. | 30/383 |

*Primary Examiner*—Willis Little

*Attorney, Agent, or Firm*—Blodgett & Blodgett

[57] ABSTRACT

Saw gage involving a retractable scale tape and a magnetic means for retaining it on a chain saw.

3 Claims, 3 Drawing Figures

SAW GAGE

BACKGROUND OF THE INVENTION

In the cutting of logs, particularly for use in a wood stove, has been facilitated by the recent development of inexpensive chain saws. Nevertheless, there is always the problem of cutting the logs into proper lengths for a given stove. The length is important, because a long-burning stove (where combustion takes place axially of the log) can fire for a longer period of time than if the log is long. On the other hand, the length can not be greater than can be placed in the stove. This means that there are maximum and minimum lengths which are desirable to cut the stock to be burned in the stove. It is, of course, possible to mark the logs by use of a ruler and pencil to obtain logs of a proper length, but in the dirty atmosphere that usually surrounds the cutting of the wood, this is not a good way to do it. Furthermore, it is important that a certain degree of speed be available in cutting the logs in order to make it economically feasible to use them and sell them at a low price. These and other difficulties experienced with the prior art devices have been obviated in a novel manner by the present invention.

It is, therefore, an outstanding object of the invention to provide a saw gage which readily attaches to a chain saw to cut logs to a desired length.

Another object of this invention is the provision of a gage for use on a chain saw which provides for accurate cutting of log length.

A further object of the present invention is the provision of a gate which may be used with a chain saw to give an optimum length of log between a desirable maximum and a desirable minimum.

It is another object of the instant invention to provide a saw gage which is compact (when retracted), so that it can be easily carried in the pocket.

A still further object of the invention is the provision of a gage for attachment to the bar of a chain saw which is capable of being securely attached to the bar and yet readily removable without the use of nuts and bolts or similar complex fastening devices.

It is a still further object of the present invention to provide a saw gage which is simple in construction, which is inexpensive to manufacture, and which is capable of a long life of useful service with a minimum of maintenance.

With these and other objects in view, as will be apparent to those skilled in the art, the invention resides in the combination of parts set forth in the specification and covered by the claims appended hereto.

SUMMARY OF THE INVENTION

In general, the invention consists of a saw gage having a housing with a first and a second outer surface facing in opposite directions. A magnet extends from the first surface to engage the surface of the bar of a chain saw. A leg extends from the second surface of the housing. A self-supporting tape is enclosed in the housing and extends from the leg.

More specifically, two pegs extend from the said first surface of the housing to engage corresponding holes in the bar of the saw. The magnets have flat end surfaces which press tightly against the surface of the saw.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 2:
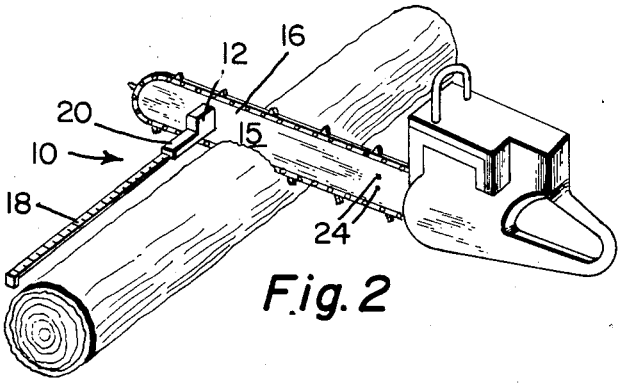
FIG. 2 is a perspective view showing the gage in use with a chain saw and a log.

Referring first to FIG. 2, which best shows the general features of the invention, it can be seen that the saw gage, indicated generally by the reference numeral 10, is attached to a flat surface 15 of the bar 16 of a chain saw and is used for cutting a log.

Figure 1:
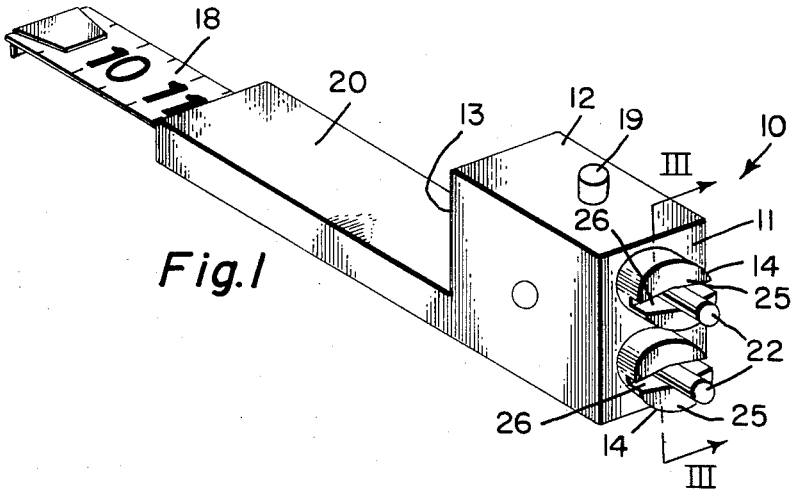
FIG. 1 is a perspective view of a saw gage incorporating the principles of the present invention.

FIGS. 1 and 2 show that the gage is provided with a box-like housing 12 having a first surface 11 and a second surface 13. Two permanent magnets 14 extend from the first surface 11 to engage the surface of the saw. A leg 20 extends from the second surface 13 of the housing and from this leg extends a self-supporting tape 18. The tape is normally coiled in the interior of the housing and extends outwardly through a slot in the leg 20. The tape is provided in the interior of the housing with a retraction means whereby (in the manner common to extendable tapes) it can be re-coiled. The tape is not only self-supporting, but also can be retracted by pressing on a locking button 19 which is used to lock the tape in its outer position.

Two pegs 22 extend from the first surface 11 of the housing to engage corresponding holes 24 formed in the surface 15 which is the flat surface of the bar 16 of the saw; the holes extend completely through the bar.

Figure 3:
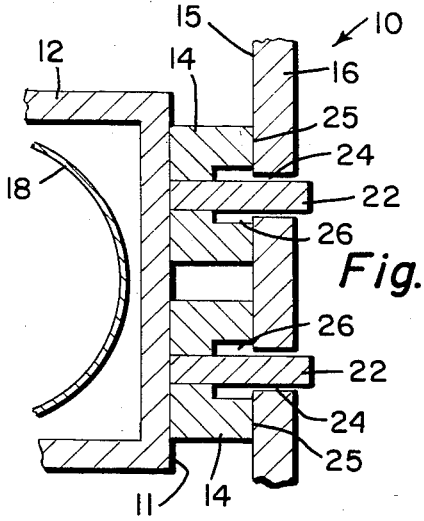
FIG. 3 is vertical sectional view through the gage taken on the line III—III of FIG. 1.

The magnets are generally cylindrical with their axes extending in the general direction of the leg 20. The magnets have flat free ends 25 (see FIG. 3) that lie in a common plane for engagement with the flat surface 15 of the bar of the saw. Each peg 22 is cylindrical and extends coaxially of a magnet 14. The free end of each magnet is provided with a slot 26 and the peg 22 associated with that magnet lies in that slot.

The operation and advantages of the present invention will now be readily understood in view of the above description. It is necessary to provide the saw with the holes 24 which may be located either close to the motor and handle of the chain saw or close to the outer end of the bar (as shown in FIG. 2). The magnets 14, being permanent magnets, need no source of electricity, so that the housing can be held against the surface 15 of the bar with the pegs 22 lying in the holes 24. The location of the pegs in this way prevents the gage from sliding on the surface due to chain and bar oil in which it normally is coated. The tape 18 is drawn outwardly until the reading at the end of the leg 20 is the reading for the desired length of the log. As is evident in FIG. 1, the markings start with a number equal to the distance from the outer and surfaces 25 of the magnets to the end of the leg 20. In this case, it is shown as 9 inches. Therefore the reading on the tape at the end of the leg 20 will indicate the distance from the surface 15 of the bar saw to the end of the tape 18. The tape will be drawn out and set for a certain distance. The saw will be placed on the log for cutting in such a way that the end of the tape is at the end of the log and the length of the log thus cut will be the proper length.

It can be seen that this device is easy to handle, can easily be carried from place to place, and can either be left on the saw or placed in the saw carrier container. The device is simple and inexpensive to manufacture and is rugged enough to last for many years of rough usage.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. In a chain saw having a bar, a gage for mounting on the surface of the bar comprising:

(a) a housing having a first and a second outer surface facing in opposite directions, (b) a magnet extending from the first surface to engage the said surface of the bar, (c) a hollow leg extending from the second surface of the housing, an opening in the second surface of said housing aligned with said hollow leg, (d) a self-supporting tape enclosed in the housing and extending through said opening into and from the hollow leg, and (e) two pegs extending from the said first surface of the housing to engage corresponding holes in the bar, said holes extending through said bar.

2. A gage as recited in claim 1, wherein the magnets are generally cylindrical with their axes extending in the direction of the leg, the magnets having flat free ends that lie in a common plane for engagement with the said surface of the saw bar, and wherein each peg is cylindrical and extends coaxially of a magnet.

3. A gage as recited in claim 2, wherein the free end of each magnet is provided with a slot and the peg associated with each magnet lies in that slot.

* * * * *